US007237421B2

(12) United States Patent
Von Allwoerden

(10) Patent No.: US 7,237,421 B2
(45) Date of Patent: Jul. 3, 2007

(54) HIGH-SPEED SHEET FEEDING WITHOUT GRIP PLIERS

(75) Inventor: Gerd Von Allwoerden, Wedemark (DE)

(73) Assignee: Amcor Limited, Victoria (AU)

( * ) Notice: Subject to any disclaimer, the term of this patent is extended or adjusted under 35 U.S.C. 154(b) by 139 days.

(21) Appl. No.: 10/494,201

(22) PCT Filed: Oct. 28, 2002

(86) PCT No.: PCT/DE02/04031

§ 371 (c)(1),
(2), (4) Date: Sep. 7, 2004

(87) PCT Pub. No.: WO03/037543

PCT Pub. Date: May 8, 2003

(65) Prior Publication Data

US 2005/0020423 A1 Jan. 27, 2005

(30) Foreign Application Priority Data

Oct. 30, 2001 (DE) ..... 101 53 481

(51) Int. Cl.
*B21D 43/12* (2006.01)
*B21D 43/24* (2006.01)

(52) U.S. Cl. ..... 72/335; 72/405.02; 72/422; 198/620; 198/626.2; 83/424

(58) Field of Classification Search ..... 72/334, 72/332, 335, 405.02, 422; 83/424, 155, 435.2, 83/271; 198/626.1, 626.2, 620
See application file for complete search history.

(56) References Cited

U.S. PATENT DOCUMENTS 1,833,470 A * 11/1931 Olson ..... 83/421
2,616,501 A * 11/1952 Smith ..... 83/221
3,053,291 A * 9/1962 Meissner et al. ..... 83/425.3
4,203,484 A 5/1980 Buhrer (Continued)

FOREIGN PATENT DOCUMENTS

DE 38 41 683 A1 11/1989

(Continued)

OTHER PUBLICATIONS

International Preliminary Examination Report of PCT/DE2002/004031 dated Feb. 11, 2004.

*Primary Examiner*—Daniel C. Crane
(74) *Attorney, Agent, or Firm*—Duane Morris LLP

(57) ABSTRACT

The invention concerns a conveying device for sheet steel plates and for moving several sheets (1, 1') inside or through a working zone (W; 50) wherein the sheets are machined. The inventive feeding device comprises first and second sheet feeders (10, 11; 20) which feed the sheets in controlled manner to the working zone (W) so that the sheets are machined with positional accuracy. The first sheet feeder (10, 11) is located on an input side of the tool zone and the second sheet feeder (20) is located on an output side of the tool zone. The two sheet feeders (10, 20; 11; 20) are mutually synchronized in their movements (x, y) when feeding forward the sheet (1), the sheet driven by the synchronous movement being maintained by the two sheet feeders. The invention provides the advantages of increased speed and safety. It is possible to increase the speed without the sheet being deformed or losing its flatness.

10 Claims, 6 Drawing Sheets

U.S. PATENT DOCUMENTS

| | | | | |
|---|---|---|---|---|
| 4,232,858 | A * | 11/1980 | Fabrig | 270/58.07 |
| 4,691,817 | A | 9/1987 | Haar | |
| 5,165,314 | A * | 11/1992 | Paulson et al. | 83/29 |
| 5,442,985 | A * | 8/1995 | Ito | 83/155 |
| 5,878,640 | A | 3/1999 | Haar | |
| 6,145,424 | A * | 11/2000 | Matsuda et al. | 83/227 |
| 6,213,666 | B1 | 4/2001 | Lang et al. | |
| 6,216,756 | B1 * | 4/2001 | Mason | 144/248.5 |
| 6,640,717 | B2 * | 11/2003 | Kosaka et al. | 101/487 |
| 6,712,197 | B2 * | 3/2004 | Kubota et al. | 198/620 |

FOREIGN PATENT DOCUMENTS

| | | | |
|---|---|---|---|
| DE | 41 24 444 | A1 | 1/1993 |
| DE | 296 23 908 | U1 | 10/2000 |
| EP | 0 178 376 | | 4/1986 |
| EP | 0 552 103 | A1 | 7/1993 |
| EP | 0 865 846 | A1 | 9/1998 |
| EP | 0 911 094 | A2 | 4/1999 |
| EP | 0 917 918 | A2 | 5/1999 |
| FR | 2 342 918 | | 9/1977 |
| GB | 2 071 062 | A | 9/1981 |
| JP | 58-216804 | | 12/1983 |

* cited by examiner

HIGH-SPEED SHEET FEEDING WITHOUT GRIP PLIERS

This invention relates to a sheet feeding device and a respective method for feeding sheets to a working zone where the sheets are machined. The machining may include a punching operation in which rounds are punched out of the sheet and arranged in close proximity due to a remaining grid on the sheet. This invention also relates to a belt drive where revolving belts handle the sheet feed function.

The starting point is state-of-the-art sheet feeders, where grip pliers are used to grip the rear end, i.e., the edge of the sheet facing away from the tool area to convey the sheets over a feeder table which is stationary into the tool area and thereby position it with an indexing movement in x and y directions so that the rounds can be cut out of the sheets by rams arranged close together in a row. The rams here have a greater distance than the centers of the rounds on the sheets, so that a lateral movement of the sheets in relation to the rams is necessary to ensure the density of the arrangement of the rounds and to minimize the residual grid that remains after punching out the shapes. In addition, to the density of the arrangement of the rounds, production speed is also a significant influencing factor for the cost of manufacturing which is to be minimized.

One approach in the state of the art is to provide two grip pliers which alternately one after the other convey sheets into the tool zone where the front grip pliers perform a return stroke oriented in the y direction when the next following grip pliers enter with the next sheet into the tool zone. A quasi-continuous conveyance may be achieved in this way although the sheets are positioned individually (see German Utility Model DE-U 296 23 908 (Naroska), page 5, second paragraph).

Another implementation from the state of the art is directed at using only a single plier which after its forward movement performs a rapid return movement in the y direction and then grips the new sheet that has been selected and positioned on the rear (edge) which follows and is facing away from the tool zone, advancing the sheet into the tool zone. Because of the high speed, synchronization problems may occur in the transfer of the sheet from a loading area via a table transfer position into the feed area, thus preventing higher speeds. In addition, the pliers used in both state-of-the-art approaches are the reason why a strip zone at the rear end area of each sheet cannot be machined after the force required for the movement has been applied by gripping in a spot application of the pliers (in the sense of a small point of action for the clamping force of the pliers in comparison with the area of the sheet). Thus if the strip area (usually also referred to as plier trim) is to be minimized as much as possible, then punching out the last row of rounds will involve an increased safety problem if the pliers extend into the tool zone and are thus very close to the punching or embossing rams.

Therefore the object of this invention is to increase the speed of conveyance from the state of the art while gaining safety and at least retaining the benefits (i.e., the useful area of the punched-out rounds in comparison with the total area of the sheet), but preferably increasing it.

This object is achieved with a conveying device according to claims 1, 5 or 15 and/or 17 having a belt conveyor device according to claim 10 or a method of conveying sheets according to claims 23, 30 or 22.

This invention eliminates the need for using tongs or grippers or pliers for the purpose of conveying the sheets. This also eliminates the spot application of the forward conveyance force on the rear end, i.e., the edge section of the sheet which is facing away from the tool. Instead of that, the force is essentially applied over a flat area, e.g., in a linear or strip pattern to the sheet to feed it into the tool zone by an indexing action (claim 5).

The continuous systems to be used for this purpose, in particular continuous systems designed with belts, are revolving drive belts which are arranged side-by-side in a plane in the form of strips supporting the sheets with their surfaces on a longitudinal section and thus permitting a drive over almost the full area although they themselves support the sheets to be conveyed (claim 8).

An essentially continuous conveyance without requiring the punching device to execute learning strokes in a regular punching cycle is achieved by means of two sheet feeders arranged one above the other, whereby an essentially flat holding function is exerted on the surface of each sheet. A sheet is supplied in suspension while the other sheet is lying on the tool zone. A transverse gap formed between the sheets thus conveyed is so small in the longitudinal direction that it is possible to speak of an alternating supply of individual sheets which is practically continuous as seen from the standpoint of the tool (claim 1).

To apply holding power to the sheets, belts having magnetizable surfaces may be used (claim 10). Alternatives to applying the force may include using a reduced pressure when the surfaces of the belts of the sheet feeds have openings with which a tensile force (as a holding force) can be applied to the sheets.

Advantages of this invention include a possible increased speed and the safety that is gained. Safety is increased because the pliers acting on the rear are omitted. Speed can be increased without the sheets being deformed out of their planar position, a condition that is very difficult to meet with plier feed acting on the rear and an increased speed. In addition, times can be shortened and the risks entailed in synchronization in synchronizing the sheets at the beginning of the forward movement with the pliers are eliminated.

The "usage" of a sheet may also be increased because in contrast with the previous plier strip, no strip area need be left unmachined here. The yield (usage) can be increased and more freedom is gained in design of the tool machining the sheets.

Experiments regarding the essentially flat support of the sheets have shown that over 300 cycles per minute can be achieved based on a punching device as the tool in the working zone.

Safety and a lower susceptibility to trouble are improved by the fact that a stationary supporting table which supports the sheet in its forward feed by the pliers according to the state of the art is no longer necessary and thus unevenness, residual sheet metal particles or irregularities on the surface of this conveyor table are eliminated. However, the conveyor table according to this invention moves with the sheet; it is formed by a plurality of individual continuous systems, each applying holding or supporting force to the sheet independently over the surface along a longitudinal section of its longitudinal extent.

Since the continuous belt systems have a top strand and a bottom strand, any cleaning of the surface may be performed on the bottom strand which does not come in contact with the sheets.

According to this invention, another sheet feed may also be provided in the output of the tool zone (claims 17 and 20). When using just one sheet feed, this may be the second sheet feed. However, if two sheet feeds are used one above the other at the input side, then the third sheet feed is used according to this invention. This feed, which is arranged downstream from the tool in the direction of travel y, operates in synchronization with the feed mechanism situated upstream from the tool. This synchronous motion pertains to the indexing movements which occur in directions y and x (main direction y) so that the sheets are guided by the tool upstream and downstream from the tool are part of their movement through the zones—upstream from the tool by holding the sheet, downstream from the tool by the transfer of the remaining grid, for example, after the punching device has punched out the rounds. The forward feed is thus composed of a pushing force and a pulling force in a plane of through-travel consisting of the inlet plane, the outlet plane and the working table surface of the machine tool.

Due to the fact that the conveyor device is provided on the output side, it is possible to machine the sheets up to the end of the rear edge so there need no longer be a strip shape remainder where in the state of the art so far the pliers have applied their holding force.

In the conveyor method (claim 22) both the input side and the output side may be provided with an uneven edge which results with a mutual alignment of the rounds due to the offset of the center points to permit maximum utilization of the sheet metal. At the same time with this sheet feed, the lateral movement may also be shortened in the incremental indexing of the sheet during its forward feed with the edge on the front end and on the rear end of each sheet being trapezoidal in shape, for example, based on the direction of conveyance y. A shortened lateral movement results in the machining being performed more rapidly and more machining devices, in particular more punching or pressing rams can be accommodated in a given width. If in the state of the art so far a transverse offset of the next row of rounds to be punched out transversely oriented row is provided, then according to this invention a linear front of rounds is no longer necessary. In the longitudinal direction there is an offset of an entire adjacent column of rounds which are aligned with their midpoints in the longitudinal direction (in the direction of conveyance y, without an offset).

Working strokes executed by the forward feed are thus instead combined in a zigzag pattern without any exclusive lateral transverse movements but instead combined by an x movement and a y direction in the forward feed and/or a lateral direction thereto in order to approach the next position for machining in a controlled manner.

EXEMPLARY EMBODIMENTS ILLUSTRATE AND SUPPLEMENT THE INVENTION

FIG. 1 shows a top view of a first example of a feed mechanism for a flat sheet 1 which is to be machined with an input feed 10, 11 and an output feed 20. They are adjacent to a working zone W which is to be assumed below is a punching device 50.

FIG. 2 shows a view of the working device W to illustrate its function and with the upper feed device 10 removed at the input so that only the bottom feed device 11 can be seen at the input with the sheet metal 1 placed on it and the conveyor device 20 at the output.

Figure 2:
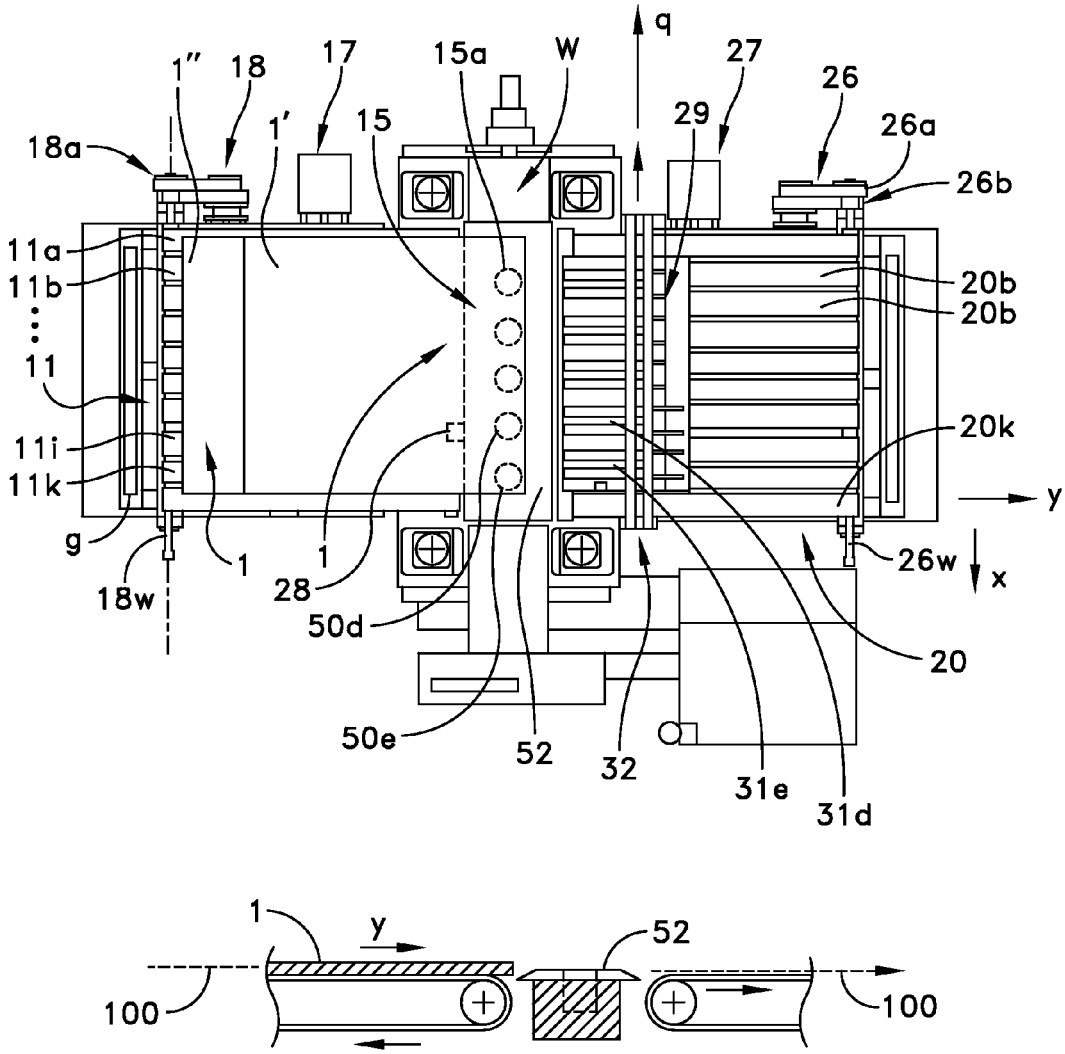
Figure 4:
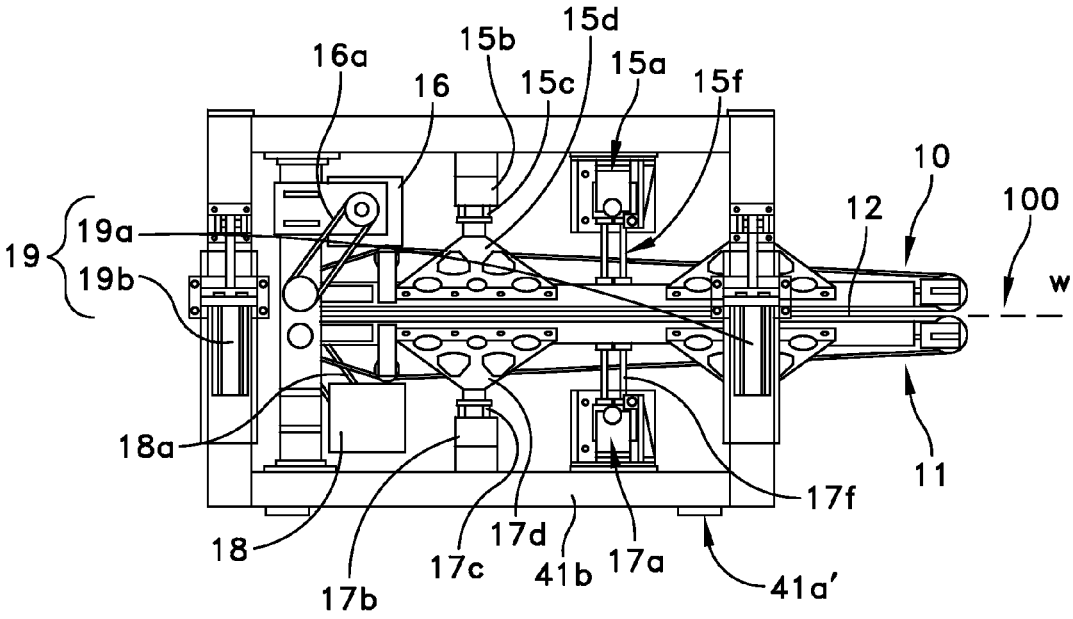
FIG. 4 shows a side view of the input conveyor device where the conveyor level or the input level 100 can be seen.
Figure 6:
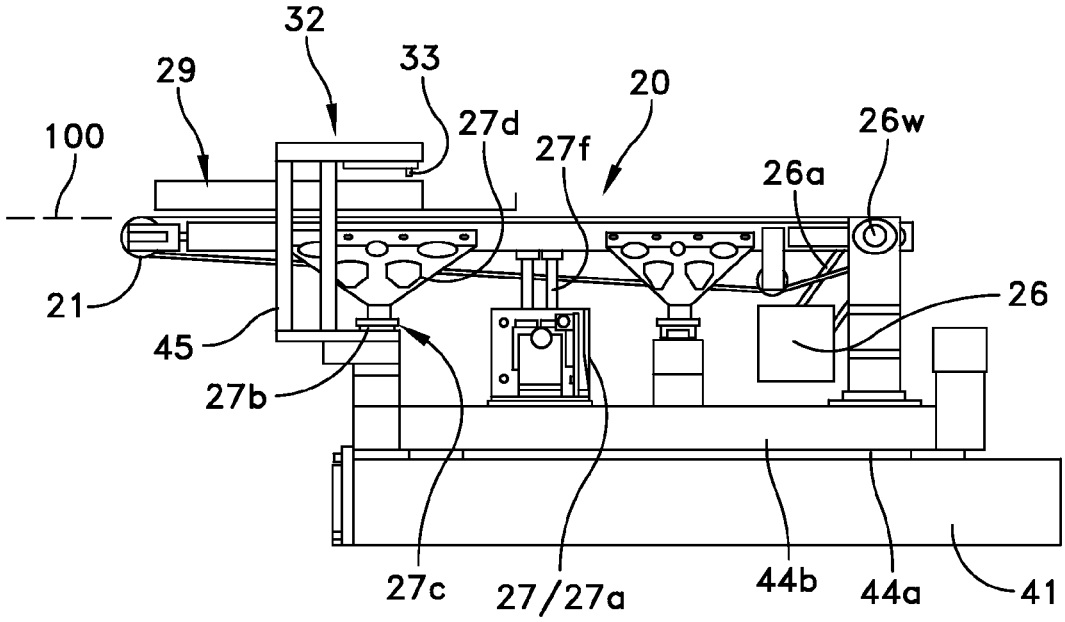

FIG. 6 shows a side view of the output conveyor device 20 with its front end defining the output plane 100 which is a continuation of the input plane of FIG. 4 and corresponds to the surface of a machining sheet 52 of the working device as shown in FIG. 2.

Figure 7:
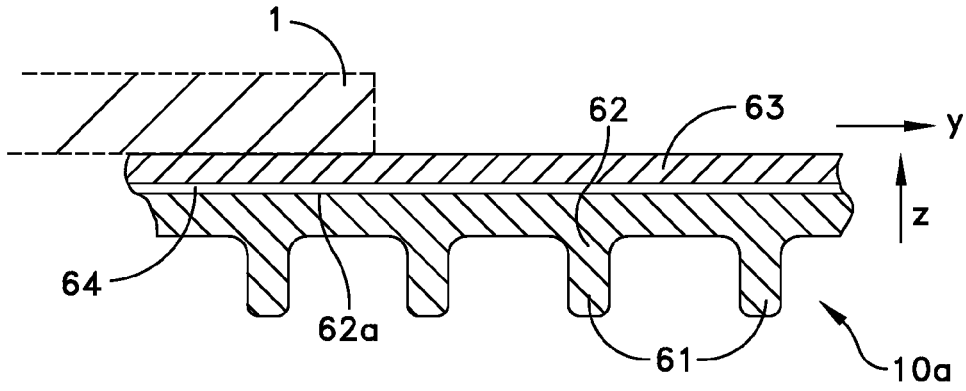

FIG. 7 shows a detail of a conveyor belt in Example 10a and its internal structure.

Figure 7A:
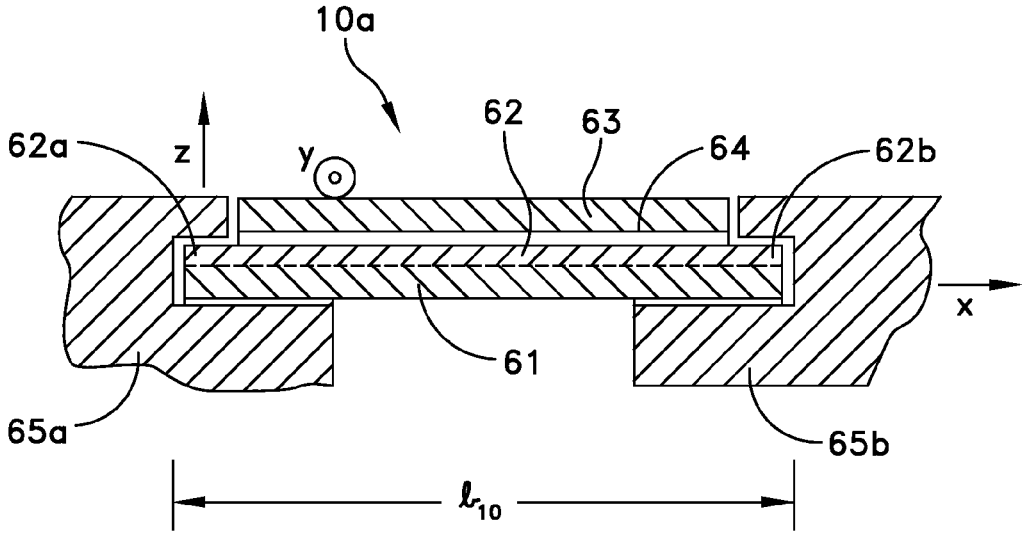

FIG. 7*a* shows a section perpendicular to the section in FIG. 7, where a lateral guidance of the conveyor belt of FIG. 7 is shown.

Figure 8:
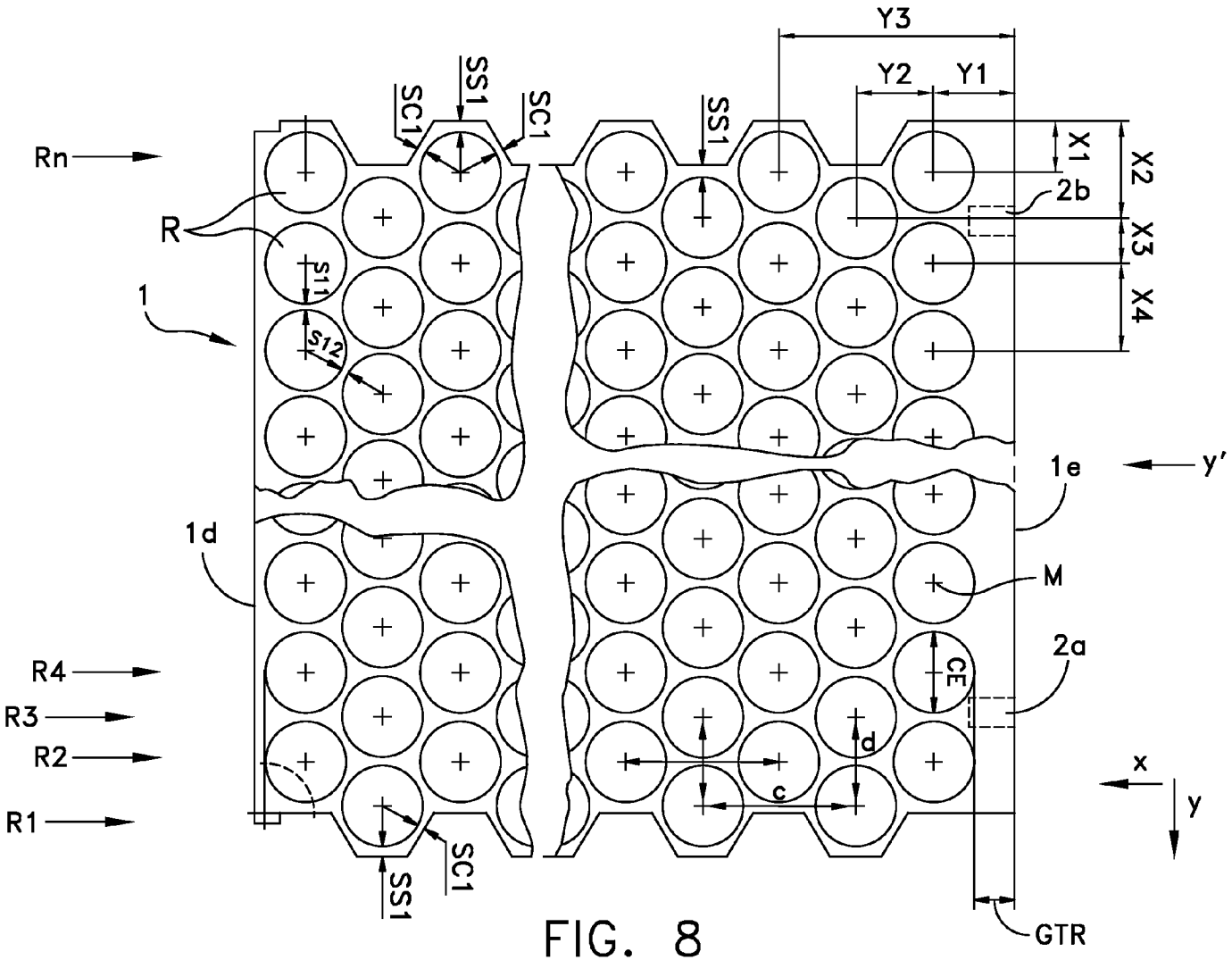

FIG. 8 shows a schematic diagram of a sheet 1 as conveyed toward the punching device by the conveyor device according to the previous figures, showing printed or drawn rounds R which are punched out by the punching device 50.

Figure 1:
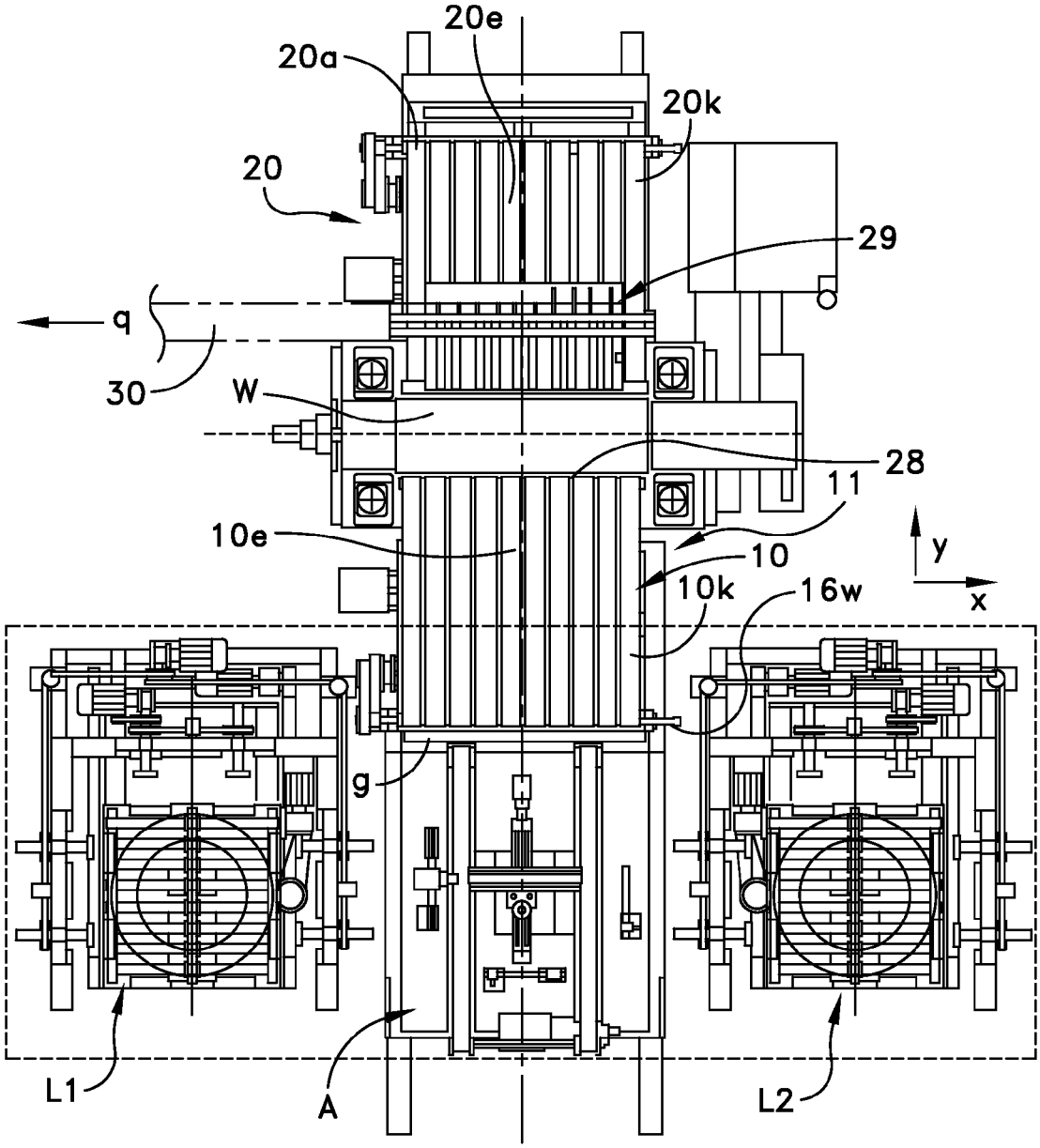

The first exemplary embodiment according to FIG. 1 shows a combination of the components used. A conveyor device 10 above and a similar conveyor device 11 which is not visible below that are each equipped with multiple parallel continuous belts, namely in the example shown here 10 belts 10*a* through 10*k* arranged side-by-side in this example. The middle belt 10*e* is shown symbolically. This conveyor device is aligned with a working zone W which in this example is formed by a punching device 50 which extends transversely. Downstream from the tool is a conveyor device 20 having a design similar to that of the conveyor device 10. It is partially covered by a discharge system 29 with the inner conveyor belts. Here again in this example, ten conveyor belts are arranged closely side-by-side as continuous systems labeled as 20*a* through 20*k*. Here again, the conveyor belt 20*e* has been shown symbolically as the longitudinal continuation of the input conveyor belt 10*e*.

The input conveyor devices 10, 11 as the first sheet conveyor mechanisms and the output conveyor device 20 as an additional sheet feed mechanism are arranged in the input and output areas respectively with respect to the tool 50.

The direction of conveyance y here is the longitudinal direction. In the transverse direction x, there is a row of working rams in the tool 50, as shown by FIG. 2. The rams 50, which are aligned here in a row and have individual punching rams 50*a*, 50*d* and 50*e*, operate in synchronization at a high frequency of up to 300 working strokes per minute corresponding to a working frequency of 5 Hz. The main direction of conveyance y is the direction of forward travel or the longitudinal direction. The continuous belt systems 10*a* through 10*k*, 11*a* through 11*k* and 20*a* through 20*k* are shown in mutual proximity in the transverse direction x in FIG. 1; the adjusting stroke used to position the sheets also occurs in the transverse direction x.

FIG. 1 also shows the input area of the input sheet transport 10, 11 with two stacks of sheets L1 and L2 arranged on both sides of an alignment station A with an H-shaped alignment and supporting device. The sheet metal here is first unstacked from one side, placed on the alignment station A (from the side) and then there is an aligning operation which aligns the sheet metal just supplied so that it is aligned correctly in relation to the tool 50 at the working point W after being supplied to the conveyor device 10, 11. When one stack L1 is depleted, the second stack of sheet metal placed on the other side of the alignment station A can be accessed directly, with the sheet metal now being unstacked from it and sent to the alignment station A coming laterally from the right. The alignment station A is followed by a switch plate 9 which is pivotable about an axis to influence the height direction or height position of the aligned sheets coming from the alignment station. To do so, the switch plate 9 is pivotable by a small angle which is synchronized with the forward feed of the current sheet out of the alignment station and into the sheet conveyance systems 10 or 11. The axis here is closer to the alignment station and the free end of the switch plate results in a slight upward deflection of a sheet feed when pivoted upward. If the switch plate is inclined out of its resting position or slightly downward, the sheet is supplied from the alignment station to the lower sheet conveyance system 11 without any change in height.

The survey diagram in FIG. 1 should illustrate which components come to lie in which location with respect to the tool device 50 in the working zone W. The function is to be described on the basis of FIG. 2 in which the upper sheet conveyance system together with its revolving belts 10*a* through 10*k* have been omitted for the sake of simplicity and a sheet 1 rests on the lower continuous conveyor system 11 with its parallel belts 11*a* through 11*k*. The sheet stack L1 and L2 as well as the alignment station A have been omitted here and the tool 50 is shown in a schematic view so that its punch rams 50*a* through 50*e* which work on the inside are discernible.

Figure 5:
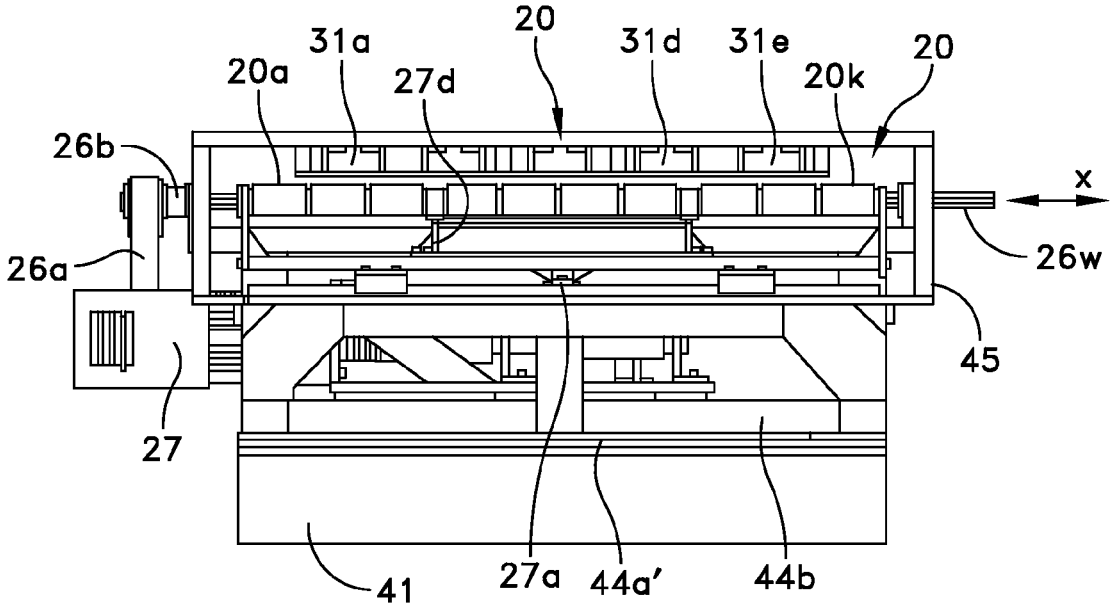
FIG. 5 shows a front view of the conveyor device at the output, also the output conveyor device 20 as seen from the working zone W.

A discharge system 29 which removes the rounds that have been punched out of the sheet in the transverse direction q along a path 30 is arranged downstream from the punching rams 50*a* through 50*e* of the punching device 50. Therefore the multiple rounds which are punched out at the same time are moved from the location of the punching ram in the main direction of conveyance y using pulsating compressed air in short blow-out channels and at the end of the short y channel segments 31*a* through 31*e* the rounds are conveyed together with a magnetic transverse conveyor belt 33 to a supporting device 32 which moves laterally in said transverse direction q which runs in parallel with the x direction. FIG. 5 gives a view into the channel segments 31*a* through 31*e*. These are extensions of the punching rams 50*a* that are aligned in the y direction. If other working devices which do not work with punching rams are used at the working location W then the discharge system may be omitted, e.g., when the working location is used only for printing the surface of the sheet, i.e., the rounds are left physically connected to the sheet.

The revolving belts 11*a* through 11*k* are driven in synchronization. A drive device 18 which is used for this purpose can be seen with a flange connection on the side; it applies a torque to a shaft 18*w* which generates a rearward deflection with deflection pulleys and generates the drive of the continuous belts. After positioning the sheet above the alignment area A in FIG. 1, the sheet is transferred to the bottom sheet conveyor 11 while the switch is lowered, and then it runs in the y direction with a longitudinal movement of the conveyor belts 11*a* through 11*k* until it is a defined distance in front of the tool position W. The sheet 1" here is stopped in the position "waiting" which is detected by at least one sensor 28. In this waiting position, the sheet waits until a sheet conveyed before it and also machined by the tool has been conveyed completely to the tool through the conveyor device which is situated above it to then be inserted seamlessly, i.e., without a blank stroke of the rams 50*a* through 50*e* moving up and down into the first punching position of the sheet 1 shown here, labeled as 1'. From this time on the sheet moves by a displacement and indexing motion in both the y direction and in the x direction so that all the given rounds as shown on a sheet in FIG. 8 as an example are punched out by the five punching rams shown here.

In doing so, this sheet is advanced over a machining table 52, the plane of which corresponds essentially to the plane 100 formed by the surfaces of the conveyor belts on which the sheet 1 comes to rest in the inserted position and in the first punching position.

The indexing movement is prompted by a drive 17 which is mounted laterally and is controlled so that the position is accurate by a control unit (not shown), where y forms the main direction of conveyance from left to right in FIG. 2; this is handled by the movement of the belts 11 and these belts are also controlled by a control unit so that the respective positions of the rounds beneath the rams are determined accurately. When the position for machining has been reached, the conveyor movement in both x and y directions is turned off and the rams are engaged. After moving the rams out of the sheet, a new indexing movement begins, composed of a combination of an x step and a y step for reaching the next position.

As shown by the subsequent side views, the indexing movement in the x direction is prompted in such a way that the entire conveyor device is displaced in the x direction, which effects all the belts 11*a* through 11*k* simultaneously and in synchronization. Because of the common driveshaft 18*w*, the movements in y direction are also in synchronization and simultaneously, triggered by the motor drive 18 which induces a controlled rotation in a drive roller via a slip-free drive belt 18*a*, with a sliding bearing being provided for the shaft 18*w* in the axial direction. The shaft 18*w* is axially movable in the drive roller but is not movable in the circumferential direction. Such a shaft may be designed for example as a grooved shaft or as a polygonal shaft in a pinion that is axially displaceable in a pinion to reduce the weight that must be moved with the conveyance in the x direction. Only the shaft 18*w* is moved here but the motor 18 and the respective drive belt 18*a* are not in motion.

The output in FIG. 2 shows multiple parallel continuous systems 20*a* through 20*k* of the sheet feed mechanism 20 where the longitudinal movement of the device in the y direction is also performed by a drive 26 which is flanged onto the side and has a belt transfer 26*a* and pulley 26*b* on a shaft 26*w* which is arranged on the end of the second sheet feed device 20 which faces away from the punching device. Here again, an indexing movement is possible and is performed in the same way as the indexing movement of the sheet feed 11 on the input side but here is performed by a drive 27 on the output side.

In the indexing movement, all the revolving belts on the input side are moving in the x direction in synchronization with those on the output side. The movement is also synchronized in the y direction so that the sheet 1 is not only held in the input but also in the output and can move into the tool on the one hand while on the other hand it can be pulled out of the tool on the output side. Therefore the output side is also to be understood as a type of feed mechanism with an effect on the sheet section which is still on the input side. However, only the remaining grid remains on the output side after the rounds have been punched out of the full area sheet on the input side but this constitutes a physical connection and thus is not capable of transmission of forces. If instead of the punching device another machining device is selected for the working zone W, then the sheet may also still be in complete form, e.g., if only printing or a surface coating is performed which does not make any changes in the mechanical consistency of the sheet as a whole.

The side view shows schematically how the work table 52 belongs together with the punching device in the working zone W where the input conveyor belt 11 is shown with parallel continuous systems and an output conveyor system 20 which also has multiple parallel continuous systems. This side and the other side of the table border these continuous systems and are in close contact with the work table 52 which may be designed with a slight inclination to receive the sheet 1 which is shown schematically in the feeding motion when the continuous conveyor system 11 conveys the sheet at the inlet according to the y direction. The conveyor plane 100 which corresponds essentially to the surface of the belts is also shown in all three components 11, 52, 20 but it may also come to lie in the plane of a sheet metal 1 that has just been conveyed or it may be formed by the surface of the table 52.

To be able to guide the sheets with forces which act at a right angle to the direction of conveyance y and to the indexing direction x, which here is assumed to be in the z direction, these sheets are designed with a special surface. FIG. 7 shows a special example.

The revolving conveyor belt 10*a* is shown here in a detail and in a sectional view. A belt base 62 is shown with a reduced thickness in comparison with that of a conventional conveyor belt and it is equipped with teeth 61 on the side facing inward, these teeth being provided at an essentially uniform distance in the longitudinal direction y. A corresponding toothed roll engages between these teeth from the driveshaft side so that multiple adjacent conveyor belts do not show any slippage in relation to one another.

On the outside, i.e., the surface of the conveyor belt 10*a* facing toward the sheet 1, a magnetic layer 63 is applied; in the example depicted here this is a film which is attached by an adhesive layer 64 to the outside surface of the base of the belt 62; it is filled with magnetic particles or is designed as a permanent magnet film. It has a height of <1 mm, in particular in the range between 0.1 and 1 mm, to maintain the elastically and flexibility of the belt but at the same time it forms essentially a flat surface on the surface to offer a possibility of holding metallic sheet metal by magnetic adhesion force in the z direction and guiding such sheets in a controlled fashion in the y direction.

Other exemplary embodiments of a conveyor belt for applying adhesive force in the z direction include those equipped with flow openings or nozzle openings to apply a force through a vacuum.

The revolving belts according to FIG. 7 are illustrated again in a sectional view in the x direction in FIG. 7*a*. Here again the magnetic layer 63 has been provided, moving in the y direction (vertically out of the plane of the paper) for conveyance purposes to the sheet 1 which is shown schematically in FIG. 7. To permit an essentially planar surface on the length of the belt and so that the belt sags little or none at all in the longitudinal direction, a lateral guidance 65*a*, 65*b* is provided for the base 62 of the belt which is held by the lateral guides in the z direction in areas 62*a* and 62*b*. The guides are designed as U-shaped rails or sections which protrude more inward in the x direction beneath the belt than above. Above the belt the thickness of the track is adapted essentially to the thickness of the magnetic layer 63 so that an essentially uniform surface is created over the entire transverse direction $b_{10}$ of the belt and the lateral guidance. If the magnetic layer 63 protrudes slightly in height with respect to the guides, so it is elevated with respect to them, the friction of the sheet metal on the lateral longitudinal guides 65*a*, 65*b* is reduced.

To simplify the design of the belt, the toothed sections 61 are also included by the lateral U-shaped guides 65*a*, 65*b*. In the driving area where the teeth are to either serve the purpose of slip-free transmission of the movement of the shaft 16*w*, 18*w* or 26*w* and the corresponding driving pinions, the belts lie freely without any lateral guidance.

The back of the belt 62 is greatly reduced in comparison with the usual backs of toothed belts, with the height of the teeth 61 being greater than the thickness of the back of the belt. Instead of a design with teeth, another design of the belt on the inside may also be selected if an essentially slip-free transmission of the movement of the drive shafts 18*w* and/or 26*w* is possible. It should be taken into account here that the driveshaft 18*w* exerts a pushing movement on the belts 11*a* through 11*k*, i.e., is at a greater distance from the working zone W than a deflecting shaft 18*v* which is arranged close to the worktable 52. A lateral guidance is less critical for the output belt 20 and may optionally be omitted because there is a forward movement here due to a pulling movement on the parallel belts 20*a* through 20*k* there, with the deflector shaft 26*v* close to the working table 52 having only a deflection function with respect to the direction of movement and not having any driving function. However, if the drive device in the working zone W can be designed in such a way that it takes up less space or if a punching device with a different division of space can be used, then a drive device on the shaft 18*v* may also be selected for the continuous conveyor system 11 so that lateral guides may also be omitted here if the length of the belt allows this to prevent sagging.

The sheets machined with the device according to FIG. 1 and in the function diagram of FIG. 2 may be used for the case when the punching device 50 is used to produce the rounds R with which metal closures for glasses for wide-neck bottles can be manufactured. Even during the punching operation, a shape may be imparted to the rounds by a deep drawing process so that a peripheral skirt edge is imparted to them; this skirt is later provided with a sealing agent and with wearing cams so it can serve as a bottle closure. This starts with round forms when the closures are to be applied by a rotating movement but it is also possible to use other rounded forms that do not have a rectangular or square design. Because of their shape, the coverage or filling of the sheet is a significant factor in determining the "usage" in the sense of the greatest possible utilization of round areas based on the total sheet area.

The sheet shown in FIG. 8 has a plurality of rounds in close proximity, with a certain alignment of the rounds to one another being provided depending on the direction of observation. In this example a movement y' of the sheet from the right to left should be assumed for the state of the art and from above in the direction y for the use in the sheet feed according to FIG. 1. On the top and bottom sides, the sheet has a corrugated pattern which may be shaped in a trapezoidal form or may be rounded (so-called "scroll edge"). The front edge 1*v* and the rear edge 1*r* form the input edge and the rear end edge respectively for the device according to FIG. 1, the latter being the last to pass through the machining device W. The side edges 1*d* and 1*e* are designed to be smooth and straight. They run parallel to a respective grid line through the center of rounds aligned in rows in the y direction. In one direction perpendicular to the side edges 1*d*, 1*e* are formed rows labeled as R1, R2, R3, R4 through Rn. The first row R1 is the row that enters the tool device 50 first at the working point W as shown in FIG. 2.

To save on sheet area, the columns of rounds, each oriented in the y direction, are each offset by a half distance from the center of the adjacent row so that the curvatures of the rounds can be situated close together. This results in a first row R1 of rounds on the front edge 1*v* which are not close together but instead have a definite distance in the x direction which is labeled as c in the first and second rows R1, R2. This distance is greater than the distance between the two grid lines running in the x direction, i.e., the distance separating them in the y direction. These comparative grid lines result from joining the centers M of the first and third rows of rounds in the x direction.

If the sheet with its scrolled (jagged or wavy or not straight) front end 1*v* is moved into the machining device 50, all the rounds of row R1 at the front are machined in one working stroke of the press 50 which moves the punching rams. Because of the greater distance c, it is no longer necessary for the rams to be arranged in such a way that there is not a pure transverse displacement in the x direction for finishing the machining of the first row and an indexing movement toward the next row R2 may take place as a shorter and faster movement than if there first had to be a lateral movement in the first row R1 to machine any rounds more closely arranged there in a second working stroke.

Eliminating this machining step in the state of the art is apparent when FIG. 8 is rotated by 90° and the edge 1*d* is regarded as the edge which enters into the tool device 50 in the y' direction (corresponding to the x direction in the example according to this invention). The rounds of the first row here (parallel to edge 1*d*) are so close together that the rams of the tool which require a greater distance can only machine every second round. A pure lateral movement is necessary to punch out the second rounds which could not be machined in the first working stroke.

For such a movement, the gripper locations 2*a*, 2*b* shown with dash-dot line would be used as they are used in the state of the art on a strip GTR having the width b. This direction of advance labeled as y' is the same as that in the state of the art, but it can be seen here that the gripper area at the edge 1*e* is very small in comparison with the total area of the sheet 1, but the width b of the strip serves to the benefit of the whole.

If the need for still having a strip area for gripping purposes is eliminated according to the conveyor device described here, then with a conveyance movement in the y direction (FIG. 8 in the original alignment) the strip on the right having a width b can be reduced to such an extent that it is also discernible on the left edge 1*d*. Consequently a sheet metal strip of the sheet material can be saved that would not otherwise be used constructively (to form rounds).

It can also be seen that the density of rounds is also unchanged in comparison with the state of the art, i.e., the usage has not been increased by merely reducing the strip width b, increasing the speed by eliminating an x indexing movement in a first row R1 and by the greater spacing of the centers in each row Rn of rounds so that more rounds are machined as flat pieces in one working stroke and in particular can be punched out than when the rounds are closer together.

Since rounds are used here as an example and need not necessarily be circular in shape, it is also possible to speak of flat pieces which are to be arranged on the sheet in such a way as to permit maximum usage of the useful area of the sheet with the least possible remaining web portion which is determined in width by the edge areas of the flat pieces which are closest together and by the properties of the machining tool, e.g., the punching device which requires a predetermined minimum residual web to be able to make a clean cut.

It was mentioned previously that a (imaginary) connecting line between the centers of the third row R3 and a connecting line between the centers of the first row R1 is used to determine their distance "d." This necessarily presupposes that there is a second row of rounds in between whose centers can be imagined as connected by a connecting line to form a second connecting line between the first and third connecting lines. This is at a distance d/2 from the first and second connecting lines.

If the distance c measured in the x direction from the centers in a first row of rounds is compared with the distance of the third grid line running in the x direction, this refers to the next-but-one grid line. When a uniform and/or orthogonal network is drawn in where all the connecting lines of all the centers running perpendicular to one another are shown, this yields a denser network line geometry in the y direction than in the x direction. The new forward feed makes use of this and uses the greater distances between the centers in the x direction to allow these rounds to be machined at the same time by the tool device 50 in this front (row).

Figure 3:
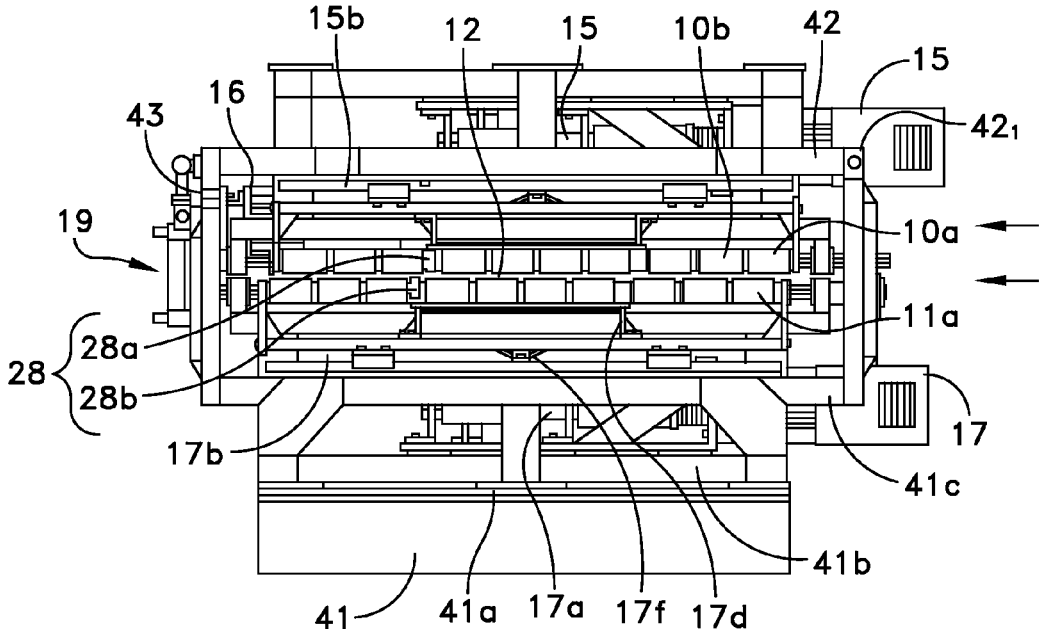
FIG. 3 illustrates the end of the input advance device pointing toward the working zone W with the upper feed 10 and the lower feed 11.

In supplementing the function of the continuous conveyance of sheets, the side views and front views of the arrangement in FIG. 1 are illustrated in greater detectable in FIGS. 3 through 6, where it can be seen in the input area of FIG. 3 that a gap 12 is formed between an upper sheet feed 10 and a lower sheet feed 11 as shown in FIG. 4. This gap is greater than the thickness of one sheet 1 as shown in FIG. 8 and as placed on the lower sheet feed 11 in the input area in FIG. 2. The side view in FIG. 4 shows a wedge-shaped belt guide for the upper conveyor belts [10] and the lower conveyor belts 11. It is elongated and aligned with the tool area W which is represented by the input plane 100 which comes to lie in the gap 12. The two opposite conveyor belt sections in gap 12 of the continuous conveyor belts aligned in parallel are equipped with the magnetic surface as illustrated in FIG. 7. The upper feed 10 can be raised with a lifting device 19 out of two lifting cylinders 19*a*, 19*b* which are a distance apart so that the upper feed 10 is raised in relation to the lower sheet feed 11.

The two sheet feeds 10 and 11 are each movable as a whole in the x direction in a controlled manner, which is achieved by drive 15 for the upper sheet feed and by drive 17 for the lower sheet feed 11, with the sheets moving over a spindle drive 15*a* and/or 17*a* so that they move a frame geometry which carries the particular continuous belt sheet conveyor and is movable with respect to a main frame.

Just as the upper sheet conveyor 10 is driven by an electrically controlled drive device 16, an upper belt drive 16*a* and an upper shaft 16*w* (see FIGS. 1 and 2), the lower sheet conveyor 11 is also driven by a drive mechanism 18 and a belt drive 18*a* on a shaft 18*w* situated at the rear. The rotational motion of the motors 16 and 18 is controlled as needed by the y forward movement during machining. The drive motors 15, 17 of the spindle drives 15*a*, 17*a* are also triggered incrementally during the machining in the tool area W as needed by the x movement. The two movements are superimposed for the upper sheet feed and the bottom sheet feed so that these sheet feeds are not active simultaneously but instead they are active one after the other.

A first sheet conveyed to the bottom sheet feed 11, for example, results in the upper sheet feed 10 with its conveyor belts being free to receive the next sheet and keep it in a ready position. Since the conveyor belts are designed to apply forces acting in the z direction (e.g., magnetically), the second sheet may also be held suspended on the bottom side of the upper conveyor belt 10 in the ready position until the bottom sheet of the bottom sheet feed 11 has been worked by the tool. Then the top sheet feed conveys and positions the next sheet for machining in the tool and the bottom sheet feed 11 picks up the next sheet and keeps it in the ready position. The transfer of the respective sheet to the upper or lower conveyor is controlled by the switch 9 by varying the position thereof.

A rail system is provided with which both sheet feeds can be inserted and retracted. The insertion and retraction pertain to the movement of a supporting main frame on rails or tracks in the direction toward the tool zone W and away from it. This is shown in FIG. 3 for the sheet feed at the input and in FIG. 5 for the sheet feed at the output. Due to a possible stoppage of the input from the working zone and stopping of the output from the same working zone which is also possible, the tool which is provided in the working zone is therefore accessible directly from both sides. To allow the movement, tracks or rails 41*a* are provided on a base 41 and sliders 41*a*' slide on the rails to permit a movement of the supporting frame 41*b* on which the entire arrangement rests with respect to the rails 41*a* and with respect to the working zone W. The same thing is also provided for the feed at the output. The base 41 here is the same foundation on which the rails 44*a* rest, guiding the sliding pieces 44*a*' on the bottom side of a supporting main frame 44*b*, 45. For precise positioning, a stop may be provided on the inside end of the rails 44*a* for stopping the supporting frame 44*b* in its end position closest to the working zone W.

The movement in the x direction is implemented in the design through a frame construction which is displaceably guided in this direction with respect to a frame construction 41*c* which is not displaceable above a bottom frame 41*b*. The top part 42 of the intermediate frame 41*c* can be opened with respect to the bottom part via a hinge 42*a* and the lifting cylinder 19 for maintenance purposes. The displaceable frame construction is a system of transverse struts and guides for the upper drive device 15 like the lower drive system 17. For the sake of standardization, the upper guidance system for the belt drive 10 is to be described with a direct transferability to the lower drive system 17 whereby the indices are each transferable, e.g., the upper element 15*a* corresponds to the lower element 17*a*, etc. The upper spindle drive 15*a* translates its movement to struts 15*f* which are situated in the x direction, two of which are shown here having a width in the transverse direction which spans at least some of the conveyor belts. Perpendicular to that are additional struts 15*d* which are spaced a uniform distance apart, each being arranged between two belts and outside of the edge of the outermost belt. These longitudinal struts 15*d* are supported with sliding blocks 15*c* on supporting frames 15*b* on which they can slide, prompted by the movements transmitted by the drive device 15 over the spindle drive 15*a* and the transverse struts 15*f* to the belt system 10. In these movements the longitudinal drive 16 is not moved with them but instead the shaft 16*w* moves in the axial direction, guided in pinions or drive rollers which are axially immovable. They are triggered by the drive 16 with the belt drive 16*a*.

The same thing is also true of the lower longitudinal drive 18 with the lower belt drive 18*a* and the lower groove shaft 18*w*. The same thing is also true in a corresponding transmission of the drive elements 15 for the lower drive elements 17, 17*a*, 17*b*, 17*c* and 17*d* and/or 17*f*.

The design of the conveyor device in the output zone of the tool is illustrated in FIGS. 5 and 6. FIG. 5 shows the view as seen from the tool side. A frame 44*b*, 45 carries the table of multiple adjacent belt conveyors 20*a* through 20*k* which can be moved in direction x. A shaft 26*w* is provided and can be induced to execute a controlled rotating motion jointly by a controlled drive 26 with a belt 26*a* so that a movement in direction y can be executed step by step. This rotational movement is synchronized with the rotational movement of the sheet feed 10 or 11 in the input area of the tool which is conveying the sheets to the tool, namely drive 16 or 18 there.

The sheet feed 20 also has magnetic surfaces on the individual continuous belts 20*a* through 20*k* which can apply forces in the z direction, for example, and therefore, like the forces in the z direction, it can also apply forces to a sheet, in particular a metallic sheet.

The indexing movement in the x direction is achieved by a controlled motor 27 and a spindle drive 27*a* in relation to the frame 45. This movement in the x direction is also synchronized with the movement over the spindle drives 15, 15*a* or 17, 17*a* in front of the tool. The drive system in the x direction for the feed is likewise designed as described with respect to the drive elements 15. With the same indices, these drive elements are accordingly labeled as 27, based on the controlled motor 27; 27*f* refers to the transverse struts with which the indexing movement is transmitted from the spindle drive 27*a* to the continuous belts 20. Longitudinal struts 27*b* are provided in the longitudinal direction with continuous belts arranged between or outside of them, sliding on sliding blocks 27*c* which are arranged on the supporting rails 27*b*. The supporting rails 27*c* are not displaceable with respect to the frame 45 which is itself in turn displaceable on the longitudinal rails 44*a* for better axis to the tool area but not during the operation of the conveyor.

The output is also depicted according to FIG. 6 in a side view where the plane 100 represents the continuation of the plane 100 in FIG. 4 directed toward the tool zone W. Above the support region which is approaching in a wedge shape, a flat discharge system 29 is provided, forming a gap with the top side of the conveyor belts 20*a* through 20*k* and supporting the discharge channels 31*a* through 31*e*. The belt 33 which is held by the supporting device 32 runs perpendicularly; it may also be magnetic to hold the rounds that have been punched out upward and convey them away laterally in the transverse direction q, as depicted in FIGS. 1 and 2.

A sheet conveyed into the tool zone is gripped by the sheet conveyor 20 in the output even before the last working operation by gripping it on the last row which is close to the read edge 1*r* of FIG. 8, then it is held there and is moved in synchronization with the movement of the inlet conveyor belts 10 or 11, depending on which is supplying the sheets at that moment. Since the sheet feed ends in the input zone of the machine upstream from the table 52 to provide it with a slight safety distance, the output conveyor can assume the function of the input conveyor even before the last stroke is executed for the last punching operation. The remaining grid after the rounds have been punched out is mechanically strong enough for this to be able to absorb tensile forces for conveying it outward.

FIGS. 1 through 3 show the position and location of sensors 28 (28*a* above, 28*b* at the bottom), which are arranged on the input sheet feed 10 or 11 in such a way that the position 1" from FIG. 2 is reliably discernable with respect to the sheet 1. An inductive proximity sensor has proven advantageous for this; it may be mounted beneath the plane formed by the surfaces of the belts. Its distance from the tool in the direction y is determined by the initial position of the sheets. If the sensor 28 detects the presence of a sheet, the drive 16 or 18 switches off, generating the forward movement in the y direction for the feed 10 or 11 affected in each case. If the previous sheet has been completely worked, then it is possible to start immediately following it from the readiness position, with only a slight gap remaining between the rear edge 1*r* of the preceding sheet and the front edge 1*v* of the new sheet so that the next sheet is already present in the tool zone before the next ram stroke triggers the next working operation in a practically continuous process. Thus the feed process does not require any blank strokes of the tool device 50 which continues to operate at a constant frequency.

Since the force applied to the sheet is not initiated from an edge but instead is initiated essentially over the entire area, i.e., by strip-shaped belt devices, therefore the supporting force is applied from the flat side of the sheets. The forward force is also applied from the flat side so that corrugations or deformations can be reliably prevented at higher feed rates.

In the input, the length of the sheet section supported by the input sheet feed changes in favor of a greater length in the output. The supporting function in the input thus changes the supported area on the flat side of the sheet based on the total area of the sheet. This is not a spot introduction of force which is transmitted at one or two small spots but instead is an essentially flat transmission over a large area but it need not be over the full area.

Depending on the distance of the wedge-shaped approaching ends of the feed mechanism 10, 11 in the input zone and the feed mechanism in the output zone, each based on the tool zone, the number of flat pieces R which are worked is determined, while only the output feed 20 is engaged. This residual sheet length may be between 1½ rows and 3 to 4 rows, depending on the size of the flat pieces as rounds.

The length of the sheet feed 20 in the output zone may be shorter than that in the input zone since the entire sheet need not ever be supported in the output zone but instead only a small portion of its length need be supported. In any case, the output conveyor is already active, however, before the last ram stroke has machined the last row Rn of flat pieces. The conveyor device in the output is not only an element for removing a residual grid from the working zone immediately after the last working stroke but instead is a feed mechanism which also operates with the input sheet feeder in a controlled manner but only in the output zone of the tool.

I claim:

1. A feed mechanism for sheets of sheet metal to feed multiple sheets into and through a working zone wherein the sheets are machined comprising:

said feed mechanism having a first and a second sheet feeder (10, 11; 20) for controlling feeding of the sheets to the working zone (W) to machine each of said sheets accurately positioned in the working zone, each of the sheet feeders having multiple continuous systems adapted to be synchronously driven in a longitudinal direction in each of said sheet feeders, and moveable jointly in a transverse direction (x) in a controlled manner for advancing each of the sheets and also accurately position each of the sheets in the working zone;

wherein the first sheet feeder (10, 11) is arranged on an input side of the working zone and the second sheet feeder (20) is provided on an output side of the working zone, the first and second sheet feeders being synchronized with one another in movements thereof (x, y) when feeding each of the sheets (1) through the working zone;

whereby each of the sheets entrained by the synchronous movements is held by the two sheet feeders.

2. The feed mechanism according to claim 1, whereby the feed movement of the two sheet feeders is composed of common movement sections in said longitudinal direction (y) and in said transverse direction (x), wherein movements in the transverse direction are mainly for positioning and movements in longitudinal direction are mainly for feeding.

3. The feed mechanism according to claim 1, whereby the sheet feeder (20) situated on the output side of the working zone (W) receives each sheet that has been machined and supports it for guiding it in synchronization with the movements (x, y) of the sheet feeder on the input side, even before a last row of rounds (Rn) has been machined by a tool in the working zone.

4. The feed mechanism according to claim 1, whereby another sheet feeder (10) for feeding sheets is arranged on the input side of the working zone and above the first sheet feeder and alternately with the first sheet feeder feeds sheets (1) to the working zone and to the second sheet feeder to prevent idle strokes of a working device in the working zone.

5. The feed mechanism according to claim 1, the machining is one of punching out rounds, shaping punched-out rounds or altering the surface of the sheets.

6. The feed mechanism according to claim 3, wherein the output side sheet feeder is adapted to receive and support a remaining grid that remains after punching out rounds from a machined sheet.

7. The feed mechanism according to claim 3, the tool for the machining is punching out the rounds row by row.

8. The feed mechanism according to claim 1, the second sheet feeder at the output side of the working zone is adapted for supporting a remaining grid after feeding out punching out rounds from a respective sheet in the working zone.

9. A feed mechanism for sheets of sheet metal to feed multiple sheets into and through a working zone wherein the sheets are machined comprising:

said feed mechanism having a first and a second sheet feeder (10, 11; 20) for controlling feeding of the sheets to the working zone (W) to machine each of said sheets accurately positioned in the working zone;

wherein the first sheet feeder (10, 11) is arranged on an input side of the working zone and the second sheet feeder (20) is provided on an output side of the working zone;

the first and second sheet feeders being synchronized with one another in movements thereof in x and y directions when feeding each of the sheets (1) through the working zone;

whereby each of the sheets entrained by the synchronous movements is held by the two sheet feeders, whereby the first and second sheet feeder each comprises an endless system and each of the sheet feeders is held by a frame, to be movable in said transverse direction, the x direction, and the endless system is movable in a longitudinal direction, the y direction, whereby the moving in y direction is caused by first and second drive shafts, and controllable motors are provided for causing movements in x and y directions, the controllable motors not being movable.

10. A feed mechanism for sheets of sheet metal to feed multiple sheets into and through a working zone wherein the sheets are machined comprising:

said feed mechanism having a first and a second sheet feeder (10, 11; 20) for controlling feeding of the sheets to the working zone (W) to machine each of said sheets accurately positioned in the working zone;

wherein the first sheet feeder (10, 11) is arranged on an input side of the working zone and the second sheet feeder (20) is provided on an output side of the working zone;

the first and second sheet feeders being synchronized with one another in movements thereof in x and y directions when feeding each of the sheets (1) through the working zone;

whereby each of the sheets entrained by the synchronous movements is held by the two sheet feeders, whereby at least one stacking area for sheets is arranged laterally in a transverse direction and near to an alignment area, positioned upstream from the sheet feeders, whereby the alignment area and at least one of the sheet feeders is movable along a rail system longitudinally passing said at least one stacking area, for shifting said alignment area and said sheet feeder away from said working zone without moving said at least one stacking area.

* * * * *

UNITED STATES PATENT AND TRADEMARK OFFICE

CERTIFICATE OF CORRECTION

PATENT NO. : 7,237,421 B2
APPLICATION NO. : 10/494201
DATED : July 3, 2007
INVENTOR(S) : Gerd Von Allwoerden It is certified that error appears in the above-identified patent and that said Letters Patent is hereby corrected as shown below:

The assignee information at section (73) should be corrected from Amcor Limited, Victoria (AU) to the following:

-- SILGAN HOLDINGS INC.
STAMFORD, CONNECTICUT 06901 --

Signed and Sealed this

Twenty Second Day of April, 2008

JON W. DUDAS
*Director of the United States Patent and Trademark Office*